US006808286B1

(12) United States Patent
Backes et al.

(10) Patent No.: US 6,808,286 B1
(45) Date of Patent: Oct. 26, 2004

(54) CONTAINER LID HAVING AN INDICATOR

(75) Inventors: Cory R. Backes, Shawnee, KS (US); Janice Meissbach, Lawrence, KS (US)

(73) Assignee: Berry Plastics Corporation, Evansville, IN (US)

( * ) Notice: Subject to any disclaimer, the term of this patent is extended or adjusted under 35 U.S.C. 154(b) by 0 days.

(21) Appl. No.: 10/410,059

(22) Filed: Apr. 9, 2003

(51) Int. Cl.[7] ..... F21V 33/00
(52) U.S. Cl. ..... 362/155; 362/394; 362/806
(58) Field of Search ..... 362/155, 109, 362/249, 251, 252, 800, 156, 154, 86, 124, 394, 806; 340/692; 215/235; 220/215

(56) References Cited

U.S. PATENT DOCUMENTS 4,020,580 A * 5/1977 Chappell et al. ..... 43/17.5
4,282,680 A 8/1981 Zaruba
4,288,006 A * 9/1981 Clover, Jr. ..... 222/42
4,305,223 A 12/1981 Ho
4,347,943 A * 9/1982 Hackwell et al. ..... 220/792
4,655,721 A 4/1987 Loomis et al.
4,698,732 A 10/1987 Hickey
4,752,273 A 6/1988 Woods
4,802,071 A 1/1989 Schuster
5,091,833 A 2/1992 Paniaguas et al.
5,392,550 A * 2/1995 Moore et al. ..... 42/117
5,566,483 A 10/1996 Ogren
5,597,230 A 1/1997 Newman
5,709,312 A * 1/1998 Lake ..... 220/287
5,739,758 A * 4/1998 Driska et al. ..... 340/692
6,200,000 B1 3/2001 Burnidge

* cited by examiner

*Primary Examiner*—Alan Cariaso
*Assistant Examiner*—Mark Tsidulko
(74) *Attorney, Agent, or Firm*—Barnes & Thornburg LLP

(57) ABSTRACT

A container lid includes a top wall covering at least a portion of an open top of a container when coupled to the container. The lid further includes an indicator and a user input that, when actuated, results in activation of the indicator.

20 Claims, 6 Drawing Sheets

CONTAINER LID HAVING AN INDICATOR

BACKGROUND AND SUMMARY

The present disclosure relates to containers, and particularly, to lids of containers, such as buckets or pails. More particularly, the present disclosure relates to a container lid having one or more indicators that activate in response to actuation of a user input.

Many containers have lids that cover, either partially or completely, openings in the containers. Some containers, such as buckets or pails, are designed for use on special occasions. For example, children and others may use containers to collect and carry items, such as candy, gifts, or other treats at cultural festivals such as Halloween, Easter, Christmas, and birthdays. During Halloween children often go from door-to-door collecting candy during "trick-or-treating." These children carry containers to hold the treats that they receive during these activities. Some containers used during Halloween have lights. See, for example, U.S. Pat. Nos. 6,200,000; 5,597,230; 4,802,071; and 4,698,732.

According to the present disclosure, a lid has a top wall that covers at least a portion of an opening in a container when the lid is coupled to the container. The lid also has a user input and an indicator that is configured to activate in response to actuation of the user input by a user.

In illustrative embodiments, the user input and the indicator are coupled to, or otherwise supported with respect to, the top wall of the lid. The user input may comprise, for example, a button, a knob, a switch, a lever, or the like. The indicator may comprise, for example, a light source and/or a sound source. The top wall of the lid may have apertures through which the indicator is viewable and through which the user input is accessible. The top wall of the lid may have an opening through which items are be placed into the container.

In addition to the indicator and the user input, the lid may have other circuit components such as a power source, a circuit board, wires or other suitable electrical conductors, an integrated circuit chip, a clock or oscillator, and discrete circuit components, including impedance components such as resistors, capacitors, and inductors. Some or all of these circuit components may be coupled directly to the top wall of the lid with suitable fasteners, may be situated within a housing that is coupled to the top wall of the lid, or otherwise may be supported with respect to the top wall of the lid via suitable supporting structure.

In some embodiments contemplated by this disclosure, the container comprises a pail and a handle coupled to opposite sides of the pail for pivoting movement along a handle pivot axis. In such embodiments, the circuitry may be arranged relative to the top wall of the lid so that the pail is balanced when the lid is coupled to the pail and the pail is carried by the handle in an upright position. The lid and/or the pail may have one or more locators that serve to properly position the lid on the pail so that the pail is balanced when being carried by the handle. In one illustrative embodiment, the locators comprise a set of stops or lugs that are appended to an annular rim of the lid and a set of notches that are formed in the pail and that are configured to receive the lugs of the lid. In another illustrative embodiment, the lid has spaced apart stops or lugs that are situated on opposite of a boss coupled to a sidewall of the pail.

In illustrative embodiments, the lid is configured for various holidays or cultural festivities. For example, the top wall of one illustrative lid is embossed with a jack-o-lantern face. The top wall of another illustrative lid is embossed with a Frankenstein-type monster face. Thus, these two lids are suitable for use during Halloween. Also contemplated by this disclosure is a lid having a top wall with an image of a heart for Valentine's Day and a lid having a top wall with an image of a Christmas tree. Thus, lids having all types of images, including Holiday-related images, are contemplated by this disclosure. Such images may be molded, stamped, or otherwise formed in the lid during manufacturing, may be printed directly on the lid, may be printed on a decal that is attached to the lid, or may be otherwise fabricated as a separate element that attaches to the lid.

In the illustrative embodiments having a jack-o-lantern face and a Frankenstein-type monster face, the user input of these lids comprises a button, which is associated with a nose of the respective face, and the indicator comprises lights, such as LED's, which are associated with the eyes of the respective face. When the "nose" button is pressed downwardly toward the pail to which the lid is coupled, the "eye" lights are turned on and may flash or pulse. The mouths of the illustrative faces provide openings for placement of items into the associated pail. In embodiments having an image of a heart, the user input may comprises a button in the shape of an arrow. The buttons of these illustrative lids may be either momentary buttons that are pressed continuously by the user to activate the associated indicator or toggle-type buttons that, after being pressed, activate the associated indicator continuously until the user presses the buttons again to deactivate the associated indicator.

Additional features of the disclosure will become apparent to those skilled in the art upon consideration of the following detailed description of illustrative embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figure 1:
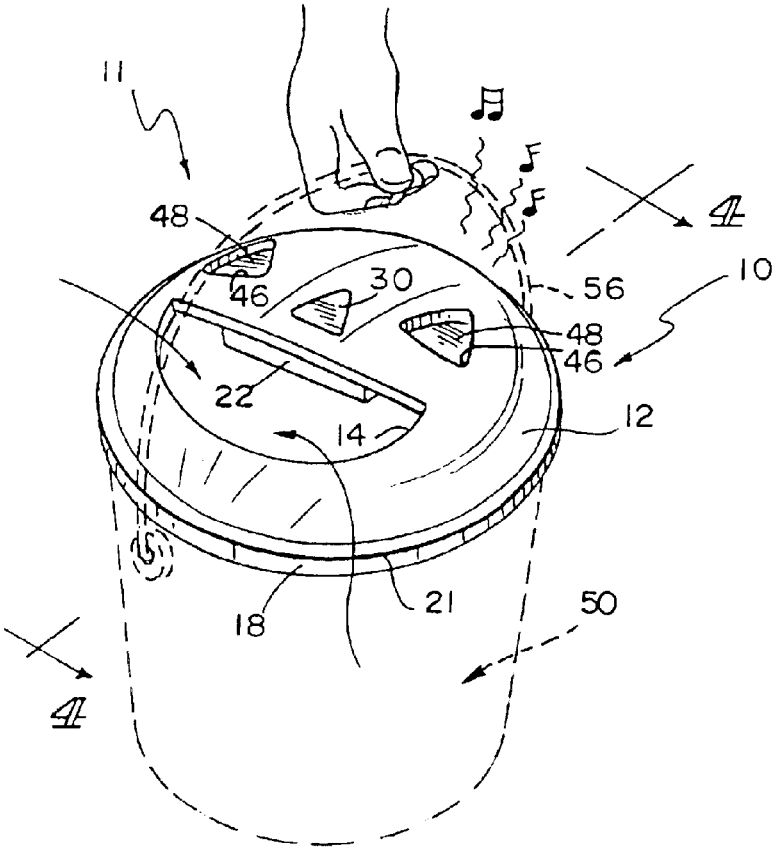
FIG. 1 is a perspective view showing a container lid in accordance with the present disclosure having a top wall with a jack-o-lantern face formed thereon and showing a user grasping a handle of a pail (shown in phantom) to which the lid is coupled.
Figure 4:
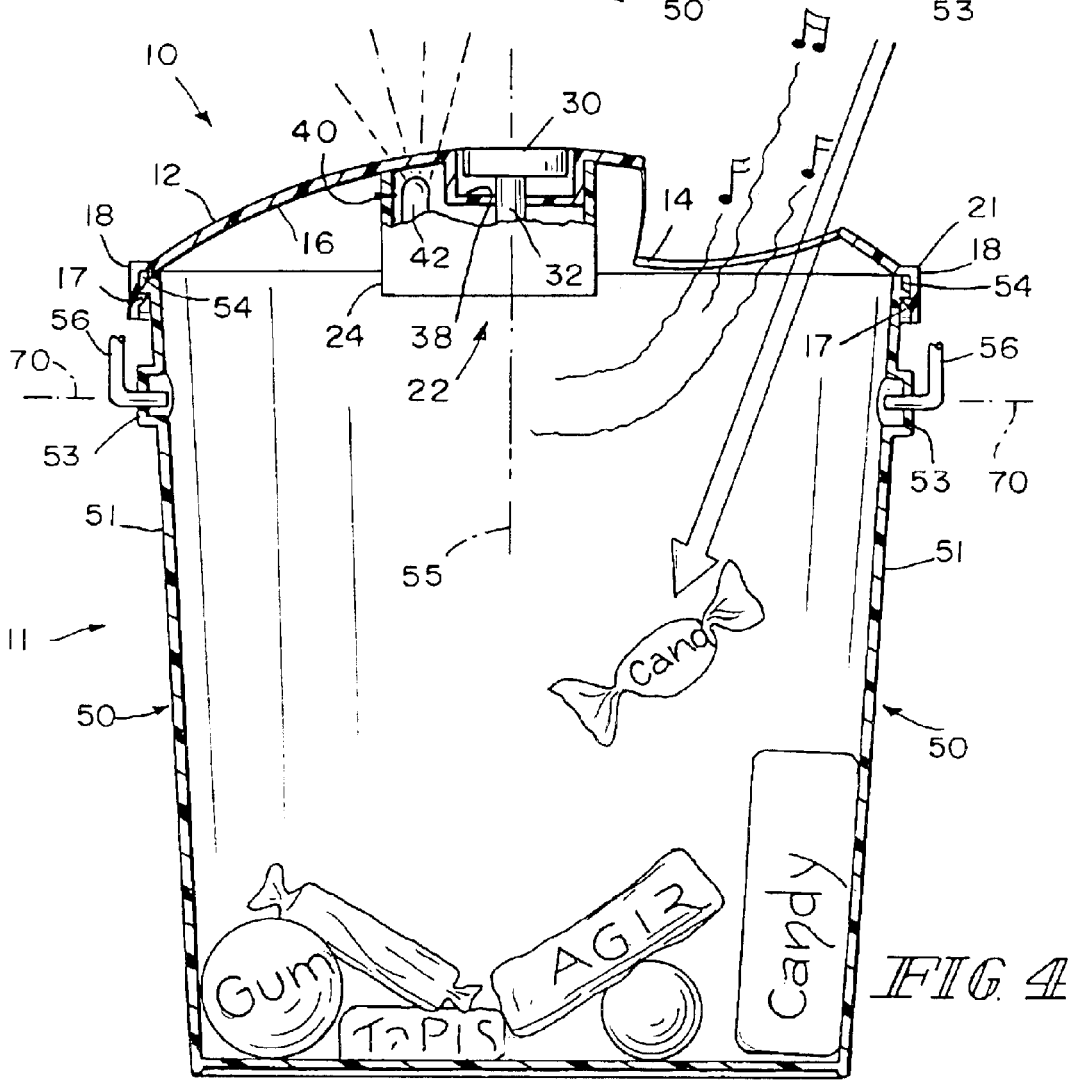
FIG. 4 is a sectional view of the lid and pail of FIG. 1, taken along line 4—4 of FIG. 1, with portions broken away, showing a button accessible through an aperture in the central region of the top wall of the lid, a light source and a sound source being activated in response to actuation of the button, and a piece of candy being dropped into the pail through an opening formed in a region of the top wall of the lid that is offset from the central region.

A container lid 10 in accordance with this disclosure is coupleable to a container, such as illustrative pail 50, to form a container assembly 11 as shown in FIGS. 1 and 4. Lid 10 includes a top wall 12, a user input 30, and an indicator 40. Indicator 40 comprises a sound source and/or a light source that is activated in response to actuation of user input 30. Illustrative user input 30 comprises a button and is sometimes referred to herein as "button 30." However, all types of user inputs, such as knobs, switches, levers, proximity sensors, touch sensors, and the like, are contemplated by this disclosure for activating indicator 40 in lieu of button 30. In the illustrative embodiment, top wall 12 covers a majority of an open top 52 of pail 50 when lid 10 is coupled to pail 50. However, top wall 12 has an aperture 14 which allows a user to insert candy or other small objects into pail 50 without having to remove lid 10 from pail 50.

Figure 2:
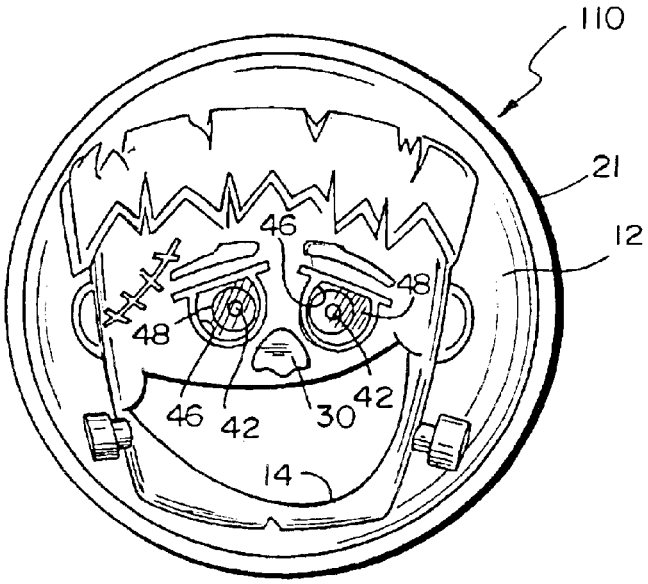
FIG. 2 is a top plan view of an alternative embodiment of a container lid having a Frankenstein-type monster face formed on a top wall of the lid.

In the illustrative embodiment of lid 10, shown in FIG. 1, top wall 12 is molded in the shape of a jack-o-lantern. However, lids in accordance with this disclosure may have other images molded therein. For example, the top wall 12 of an alternative container lid 110, shown in FIG. 2, has the face of a Frankenstein-type monster molded therein. Lid 110 is similar to lid 10 and therefore, like reference numerals are used to denote portions of lid 110 that are substantially similar to like portions of lid 10. Lids 10, 110 are suitable for use during Halloween festivities. Aperture 14 of each lid 10, 110 is formed to resemble a "mouth" of the associated face formed on the respective top wall 12. The user input 30 of each lid 10, 110 is associated with a "nose" of the respective face. In addition, the indicator 40 of each lid 10, 110 comprises lights, such as LED's, that are associated with "eyes" of the associated face of the respective top wall 12.

Although the jack-o-lantern face of lid 10 and the monster face of lid 110 are molded in the associated top wall 12, lids having images that are stamped, engraved, embossed, etched, or otherwise formed in the lid during manufacturing are contemplated by this disclosure, as are images that are printed directly on the lid, images printed on a decal that is attached to the lid, or images that are otherwise fabricated as a separate element which attaches to the lid. Furthermore, lids having all types of images, including Holiday-related images, or no images at all, are contemplated by this disclosure. For example, a lid having a top wall 12 formed with a heart and having a button 30 shaped like an arrow is contemplated by this disclosure for use during Valentine's day.

Figure 3:
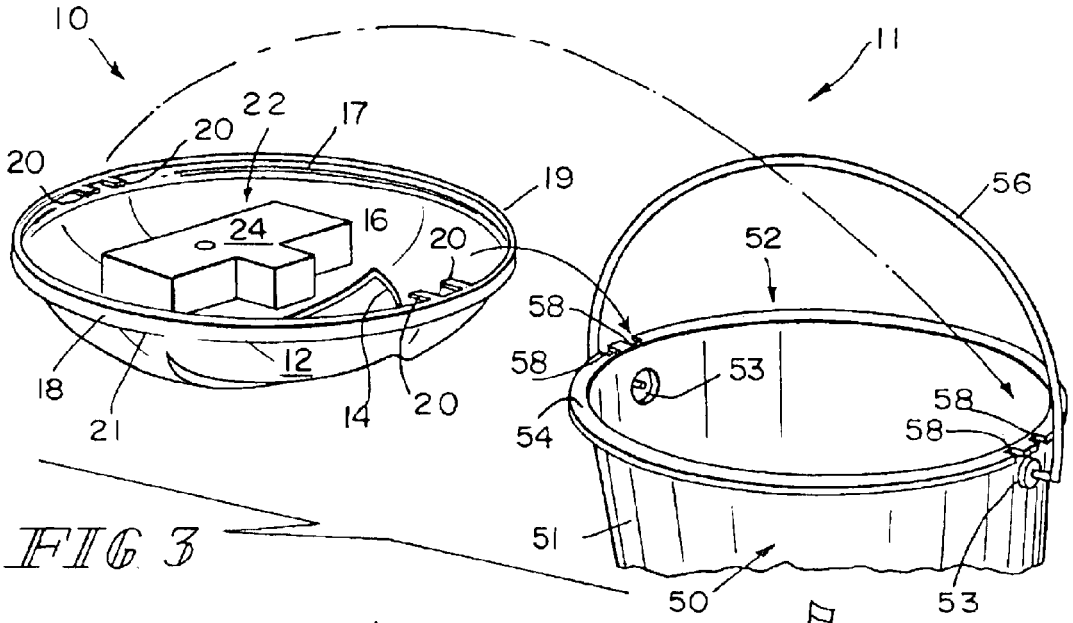
FIG. 3 is a perspective view of the underside of the container lid of FIG. 1 showing a circuit-carrying housing appended to an underside of a top wall of the lid, and a plurality of locators coupled to an inner surface of an annular rim.

Referring now to FIG. 3, lid 10 further includes a circuit assembly 22 having a housing 24 which is coupled to an underside 16 of top wall 12. Illustratively, assembly 22 is situated on or near a central region of underside 16 and aperture 14 is offset from the central region. Lid 10 has an annular rim 18 depending from a circumferential edge 21 of top wall 12. Appended to annular rim 18 are a plurality of stops or locator lugs 20 and a rib 17 as shown in FIGS. 3 and 4. Lid 10 is secured on pail 50 by rib 17 which snaps over a chime 54 of pail 50. Rib 17 projects from an inner surface of rim 18 and is situated between a bottom edge 19 of rim 18 and the circumferential edge 21 of top wall 12. Rib 17 is arranged for gripping engagement of chime 54 so that lid 10 is held securely on pail 50 when placed thereon by a user. However, rib 17 snaps over chime 54 when a sufficient amount of force is applied to remove lid 10 from pail 50.

Locator lugs 20 aid in properly locating lid 10 on pail 50. Lugs 20 are arranged in pairs that are substantially in diametric relation with each other. In addition, each lug 20 projects away from bottom edge of rim 18 and is cantilevered generally toward the center of lid 10. During coupling of lid 10 to pail 50 locator lugs 20 pass through respective guide notches 58 formed in chime 54 of pail 50. After lid 10 is coupled to pail 50, a set of stops (not shown) that are formed in or otherwise coupled to a sidewall 51 of pail 50 interact with lugs 20 to prevent rotation of lid 10 on pail 50.

Pail 50 has a handle 56 that is coupled to bosses 53 formed in sidewall 51 as shown in FIGS. 3 and 4. Handle 57 is pivotable about an axis 70 relative to sidewall 51 of pail 50. Housing 24 of lid 10 has an interior region in which is situated various circuit components of assembly 22, including a power source 28, such as one or more batteries. Illustratively, assembly 22 is shifted slightly off center relative to a common central axis 55 of lid 10 and pail 50 as shown in FIG. 4. The central axis 55 of lid 10 and pail 50 intersects and is perpendicular to axis 70 about which handle 56 pivots. The center of gravity of lid 10 is offset from axis 55 due to the fact that circuit assembly 22 of lid 10 is offset from axis 55 in one direction and aperture 14 is offset from axis 55 in an opposite direction.

Illustratively, notches 58 are formed in chime 54 above bosses 53. Each locator lug 20 cooperates with an associated guide notch 58 and any stops of pail 50 to align lid 10 on pail so that the center of gravity of lid 10, which is offset from axis 55, is located vertically above axis 70 when axis 70 is oriented horizontally as shown in FIG. 4. Locating lid 10 on pail 50 in this manner prevents pail 50 from tipping in an unwanted manner about axis 70 when pail 50 and lid 10 are carried by a user with handle 56 in an upright position. Thus, locator lugs 20, notches 58, and any associated stops of pail 50 are arranged and configured to compensate for the nonsymmetric weight distribution of lid 10 so that pail 50 is balanced in a level attitude when a user holds handle 56 in an upright position.

Figure 5:
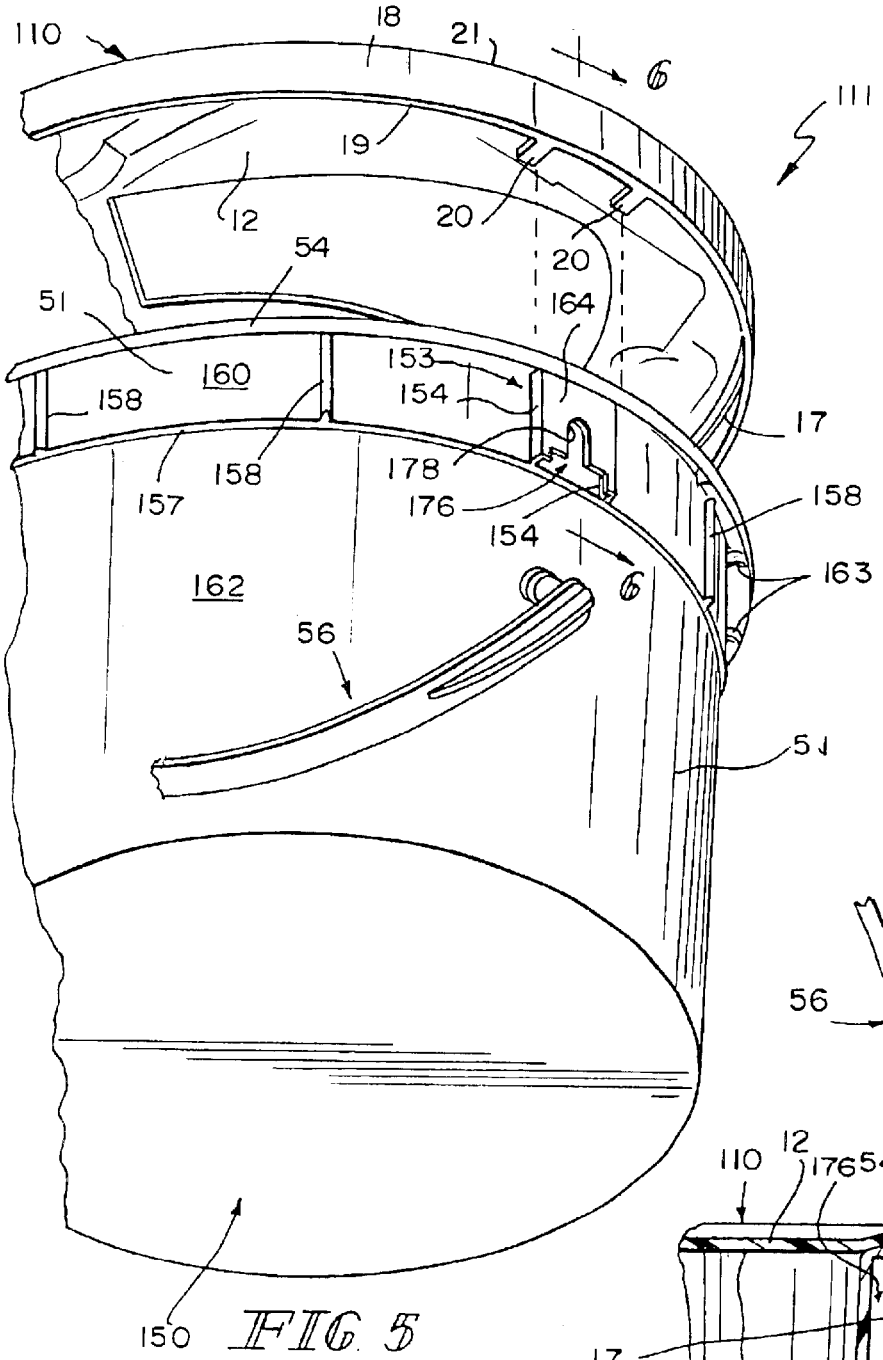
FIG. 5 is an exploded perspective view of a portion of an alternative container showing a pail of the container having a boss with a keyhole slot for receiving a coupling portion of a handle and showing a lid of the container having a pair of stops that are spaced apart to receive the boss therebetween to prevent rotation of the lid on the pail.

An alternative container assembly 111 includes lid 110 and a pail 150 that has handle-receiving bosses 153 with vertically extending side edge walls 154 as shown in FIG. 5. Portions of pails 50, 150 that are substantially similar are denoted with like reference numerals. Thus, pail 150 has a sidewall 51, a chime 54 at the upper periphery of sidewall 51, and a handle 56. An upper portion 160 of sidewall 51 beneath chime 54 is connected to a main portion 162 of sidewall 51 by a shoulder or step 157 which extends from the bottom of portion 160 inwardly toward the center of pail 150 to connect to the top of portion 162. In addition, pail 150 has a set of vertically extending ribs 158 appended to upper portion 160 of sidewall 51 and a set of chime-reinforcing ribs 163 appended to an undersurface of chime 54. Step 157 and ribs 158 allow for several pails 150 to be stacked without becoming wedged together. That is, when pails 150 are stacked, step 157 and the bottom of the associated ribs 158 of each pail 150 engage chime 54 of the next adjacent pail 150 lying thereunder.

Figure 6:
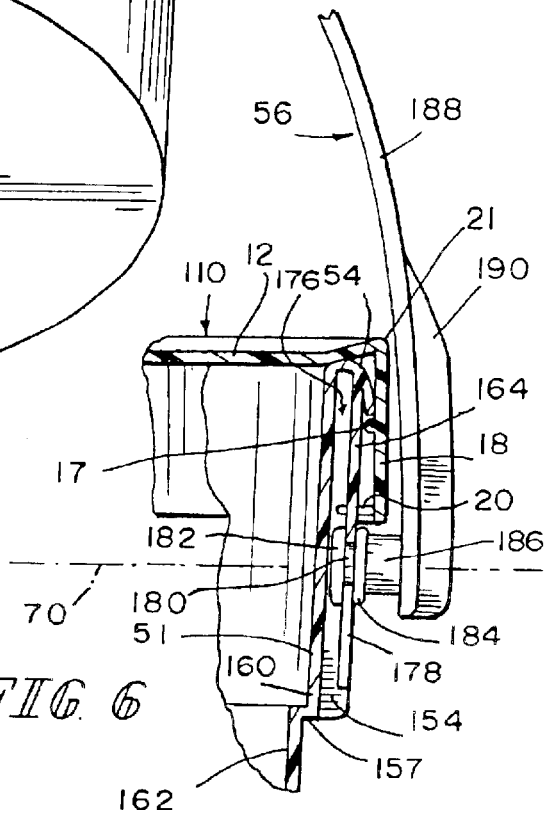
FIG. 6 is a sectional view taken along line 6—6 of FIG. 5 showing the interconnection between the pail, the handle, and the lid.

Each boss 153 has an outer wall 164 that extends between side edge walls 154 in spaced and substantially parallel relation with upper portion 160 of wall 51. Thus, a space 176 is defined between each wall 164 and upper portion 160 of sidewall 51 as shown in FIGS. 5 and 6. Wall 164 of each boss 153 has a keyhole-shaped slot 178, shown best in FIG. 5, with a circular upper portion that receives a cylindrical portion or post 180 of handle 56 therein as shown in FIG. 6. The upper portion of each slot 180 is configured to provide pin 180 with a rotative bearing surface so that handle 56 is able to pivot about the associated axis 70, shown in FIG. 6.

The description below of the structure at one end of handle 56 is applicable to the structure at the other end of handle 56 as well. An inner disk 182 is appended to post 180 and is received in space 176 between wall 164 and portion 160. An annular flange 184 extends radially outwardly from post 180 and is situated adjacent wall 164 outside of space 176. The diameters of disk 182 and flange 184 are larger than the diameter of post 180 such that a portion of wall 164 is located between disk 182 and flange 184 with only a small amount of clearance therebetween. Thus, disk 182 prevents post 180 from being axially withdrawn from slot 180 and flange 184 prevents post 180 from being pushed axially inwardly toward portion 160 of sidewall 51. The lower portion of slot 180 is open at the bottom edge of wall 164 and is configured to permit post 180 to snap into and out of the upper portion of slot 178. Handle 56 of container assembly 111 has a cylindrical connector portion 186 that extends between flange 184 and a main-carrying portion 188 of handle 56. Handle 56 of container assembly 111 also has a stabilizing rib 190 which is generally perpendicular to the main carrying potion 188 of handle 56.

As was the case with lid 10, lid 110 has an annular rim 18 depending from a circumferential edge 21 of top wall 12. Appended to annular rim 18 are a plurality of stops or locator tugs 20 and a rib 17 as shown in FIGS. 5 and 6. Lid 110 is secured on pail 150 by rib 17 which snaps over chime 54 of pail 150 as shown in FIG. 6. Rib 17 projects from an inner surface of rim 18 and is situated between a bottom edge 19 of rim 18 and the circumferential edge 21 of top wall 12. Rib 17 is arranged for gripping engagement of chime 54 so that lid 10 is held securely on pail 50 when placed thereon by a user. However, rib 17 snaps over chime 54 when a sufficient amount of force is applied to remove lid 10 from pail 150.

Locator lugs 20 aid in properly locating lid 110 on pail 150. Lugs 20 are arranged in pairs that are substantially in diametric relation with each other. In addition, each lug 20 projects away from the bottom edge of rim 18 and is cantilevered generally toward the center of lid 110. Due to the flexibility of both sidewall 51 and chime 54 of pail 150, and due to the flexibility of lugs 20 of lid 110, lugs 20 are able to snap over chime 54 during coupling of lid 110 to pail 150. After lid 110 is properly coupled to pail 150, lugs 20 are situated on either side of bosses 153 with only a small amount of clearance, if any, between lugs 20 and the associated side edge walls 154. Thus, in the case of container assembly 111, bosses 153 serve as a set of stops that interact with lugs 20 to prevent rotation of lid 10 on pail 50.

Figure 7:
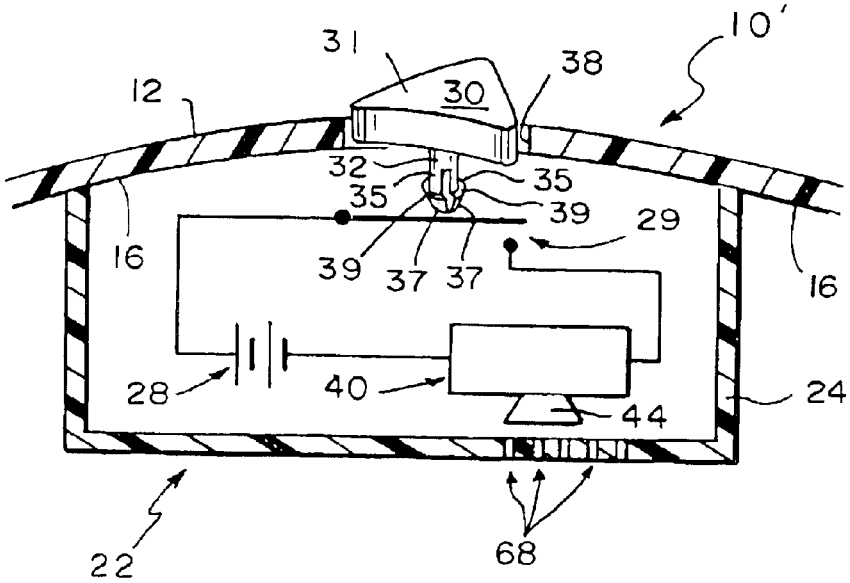
FIG. 7 is a part sectional, part schematic view of the lid of FIG. 1, showing the button having a triangular shape associated with the nose of the jack-o-lantern face and showing a schematic of an electric circuit having a voltage source, a sound-producing device, and a switch or contact that is closed by pressing the button downwardly toward the container.
Figure 8:
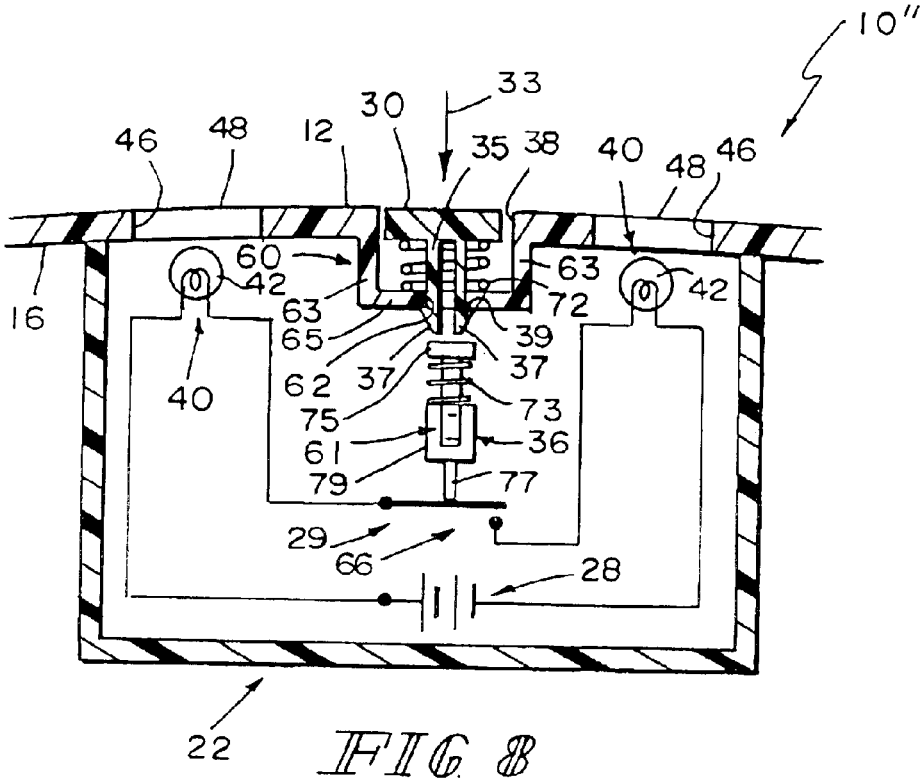
FIG. 8 is a part sectional, part diagrammatic view of an alternative embodiment of a lid showing a button situated in a button-receiving recess formed in a central region of a top wall of the lid and showing a schematic of an electric circuit having a voltage source, a pair of light-emitting diodes, and a switch that is closed by pressing the button downwardly toward the container.

As mentioned above, indicator 40 may include a light source and/or a sound source. The light source may comprise, for example, one or more light-emitting diodes (LED's) 42 as shown in FIGS. 4 and 8. The sound source may comprise a speaker or buzzer 44 as shown in FIG. 7. Exemplary lid 10 has both a sound source (sometimes referred to herein as "sound source 44") and a light source (sometimes referred to herein as "light source 42") as indicated in FIG. 4 by musical notes emanating from assembly 22 and by dashed lines emanating from LED 42, respectively. An alternative lid 10', shown in FIG. 7, has a sound source 44 but no light source. Another alternative lid 10", shown in FIG. 8, has a pair of light sources 42 but no sound source. Components of lids 10, 10', 10" that are substantially similar are denoted with like reference numerals. As shown in FIGS. 7 and 8, the circuitry carried by housing 24 of assembly 22 includes power source 28 and a contact 29 that is opened and closed in response to movement of button 30. When contact 29 is closed, power from power source 28 is applied to indicator 40 to activate indicator 40 to produce light and/or sound, as the case may be.

An upper portion 31 of button 30 is received in an aperture 38 formed in top wall 12 as shown in FIGS. 7 and 8. Button 30 is pressed downwardly toward pail 50 from a first position to a second position to close contact 29 thereby to activate indicator 40. Suitable structure is provided for supporting button 30 for movement relative to top wall 12 between the first and second positions. For example, in the case of lid 10", a button-receiving well or receptacle 60 is appended to underside 16 of top wall 12. Inner surfaces of sidewalls 63 of receptacle 60 cooperate with aperture 38 to provide guide surfaces for the upper portion 31 of button 30.

Illustrative button 30 has a post 32 extending downwardly from an underside of the upper portion 31. Post 32 comprises two tines 35, each of which has a lateral protrusion formed at a lower end thereof. Each lateral protrusion has a generally semi-frustoconical outer surface 37 and an upwardly facing shoulder surface 39. A bottom wall 65 of receptacle 60 has an aperture 62 which receives post 32 therein for sliding movement. A slot is defined between tines 35. During assembly of lid 10", post 32 is inserted through aperture 32 so that surfaces 37 wipe against aperture 62 to deflect tines 35 toward each other so that the lateral protrusions at the ends of tines 35 can pass through aperture 62. After the lateral protrusions pass through aperture 62, tines 35 flex away from each other such that shoulder surfaces 39 confront an underside of bottom wall 65 of receptacle 60.

Lid 10" has a spring 72 that is coiled about post 32 and that is maintained in a state of compression between portion 31 of button 30 and bottom wall 65 of receptacle 60 as shown in FIG. 8. Spring 72 biases button 32 into the first or upper position having the upper surface of button 30 generally flush with top wall 12. When button 32 is in the first position, surfaces 39 abut the underside of bottom wall 65. When button 30 is pressed downwardly, in the direction indicated by arrow 33 in FIG. 8, surfaces 39 separate away from wall 65 of receptacle 60 and spring 72 is further compressed. Upon release of button 32, spring 72 moves button 32 back to the first position.

In the illustrative embodiment of lid 10', button 30 acts directly on contact 29 as shown in FIG. 7. The contact 29 of lid 10' may be biased toward the open position by a torsion spring, for example. Thus, contact 29 of lid 10' is closed only while button 30 is being pressed by a user and automatically returns to the open position, thereby deactivating the indicator 40, when the user no longer presses button 30. In the illustrative embodiment of lid 10", a switch assembly 36 is situated between button 30 and contact 29. Switch assembly 36 includes a spring-biased plunger 61 having a head 75 that is contacted by the lower end of post 32 when button 30 is pressed downwardly and having a rod 77 that interfaces with contact 29. Switch assembly 36 also has a spring 73 that is coiled about a portion of rod 77 and that is maintained in a state of compression between head 75 and a housing 79 through which rod 77 extends.

Switch assembly 36 is configured as a snap-action or toggle type switch that moves contact 29 between the opened and closed position and leaves contact in the opened or closed position, as the case may be, until the next successive actuation. Thus, when assembly 36 is actuated a first time, contact 29 may be moved from the opened position to the closed position and left in the closed position until a second actuation of assembly 36. Actuation of assembly 36 is achieved by pressing button 30 downwardly in the direction of arrow 33 and then releasing button 30. Plunger 61 moves downwardly each time button 30 is pressed downwardly due to the lower end of post 32 engaging head 75 of plunger 61. Thus, successive presses of button 30 acts through switch assembly 36 to complete and interrupt successively an electric circuit 66 defined by power source 28, contact 29, indicator 40, and the electrical conductors interconnecting these components. In some embodiments, current-limiting resistors are included in circuit 66.

Housing 24 of assembly 22 is configured with appropriate mounting or supporting structure to hold power source 28, contact 29, indicator 40, and other components of assembly 22, such as switch 36 in the case of lid 10", in place relative to top wall 12. For example, housings 24 of lids 10, 110 are each configured so that associated light sources 42 are supported at locations so as to be visible through corresponding indicator apertures 46 that are formed in the associated top walls 12 as shown in FIGS. 1–4. Indicator apertures 46 are each covered with a transparent lens 48 that is coupled to top wall 12 to protect or shield light source 42. In some embodiments, lenses 48 are tinted. Indicator apertures 46 of lids 10, 110 are formed to resemble the "eyes" of the faces that are molded into the associated top walls 12. As another example, housing 24 of lid 10' is configured so support sound source 44 in an interior region thereof. Housing 24 of lid 10' is formed to include a plurality of apertures 68 in a bottom wall 78 thereof to reduce the amount of attenuation of sound produced by sound source 44.

Figure 9:
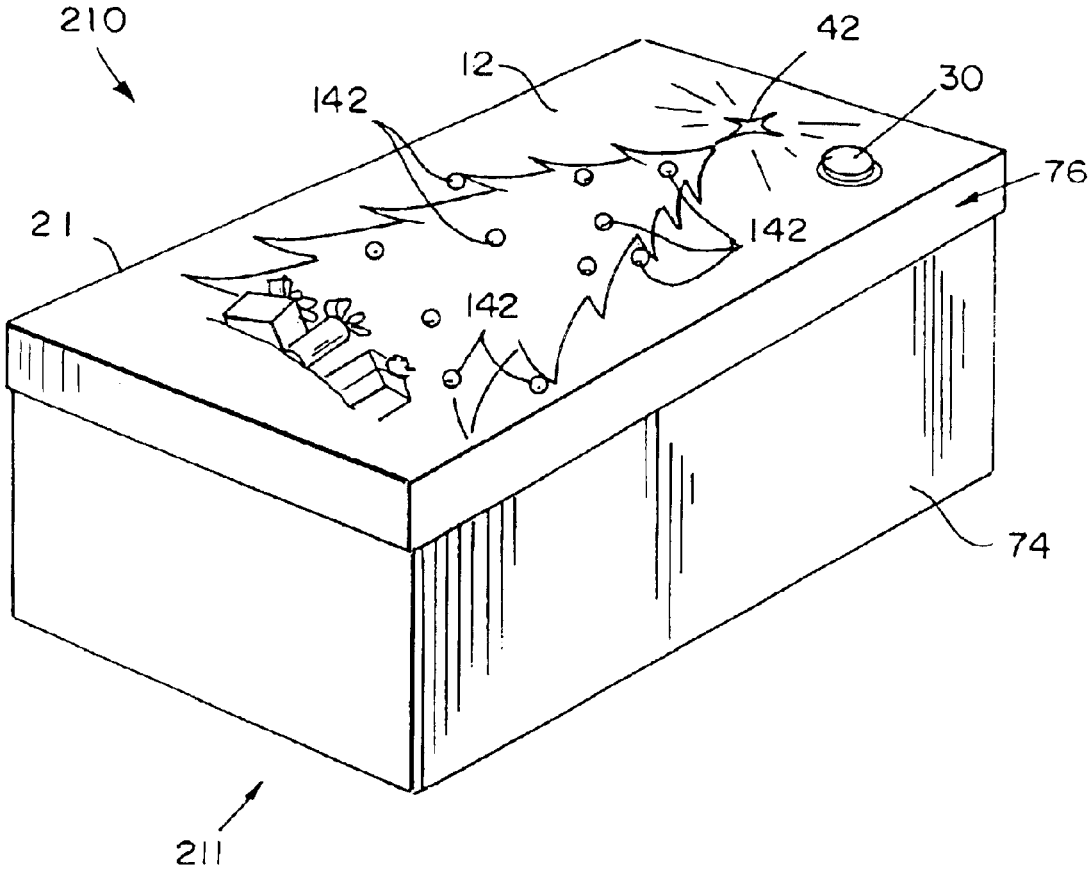
FIG. 9 is a perspective view showing an alternative embodiment of a lid having an image of a Christmas tree provided on a top wall of the lid and the lid being coupled to a box-like container.

Although illustrative lids 10, 110 have circumferential edges 21 that are substantially circular, such that lids 10, 110 are considered to be round lids, it is within the scope of this disclosure for lids to have shapes other than round. For example, an alternative lid 210 has a rectangular shape and covers an open top of a box-like container 74 to form a container assembly 211 as shown in FIG. 9. That is, a perimetral edge 21 of top wall 12 of lid 210 is rectangular in shape. Lid 210 has a rectangular rim 76 which surrounds the upper portions of the sides and ends of container 74 when lid 210 is coupled to container 74. Lids that are triangular, oval, hexagonal octagonal, star-shaped, or any other shape are contemplated by this disclosure. Each of such alternative lids may have any of the user inputs 30 and indicators 40 described above with reference to lids 10, 10', 10", 110.

Top wall 12 of lid 210 has an image of a Christmas tree thereon and light source 42 of lid 210 is associated with a "star" at the top of the Christmas tree. When user input 30 of lid 210 is actuated, the star lights up and, optionally, may flash or pulse. In alternative embodiments, other lights 142 associated with the Christmas tree may be turned on either simultaneously or in some type of blinking pattern. As shown in FIG. 9, button 30 is not integrated into the image of the Christmas tree, but is located on a portion of top wall 12 adjacent to the image of the Christmas tree. In some embodiments, lid 210 has a sound source and associated circuitry with a memory device in which is stored some or all of a song associated with the Christmas season. In such embodiments, pressing button 30 activates the circuitry to play the song. Lids having images with Holiday-based themes, therefore, may also have circuitry for playing songs associated with the particular Holiday.

Lids 10, 10', 10", 110, 210 according to the present disclosure may be fabricated from a variety of materials which may be formed into the desired configuration. For example, in some embodiments of lid 10, top wall 12, rim 18, rib 17, and stops 20 are made of one-piece plastic construction. In such embodiments, tabs or fingers which grip housing 24 of circuit assembly 22 may be formed integrally with lid 12. Such tabs or fingers extend from underside 16 of top wall 12 and are arranged to support assembly 22 in the proper location with respect to top wall 12. Suitable plastic materials include thermoplastics, high-density polyethylene, polyvinyl chloride, polypropylene, acrylics, and the like. Housing 24 of circuit assembly 22 may be made from a material that is the same as or different from the material from which other portions of the associated lid is made. Portions of lids 10, 10', 10", 110, 210 may be made from metal, composite materials, fiber glass, fiber board, cardboard, paper board, paper, leather, fabric, glass, or any other type of material having suitable strength and/or desirable aesthetic characteristics. Different portions of lid 10 may be made from different materials. Portions of lid 10 may be laminated. For example, a flexible decorative layer may be laminated or otherwise adhered to an underlying generally rigid structural layer.

Figure 10:
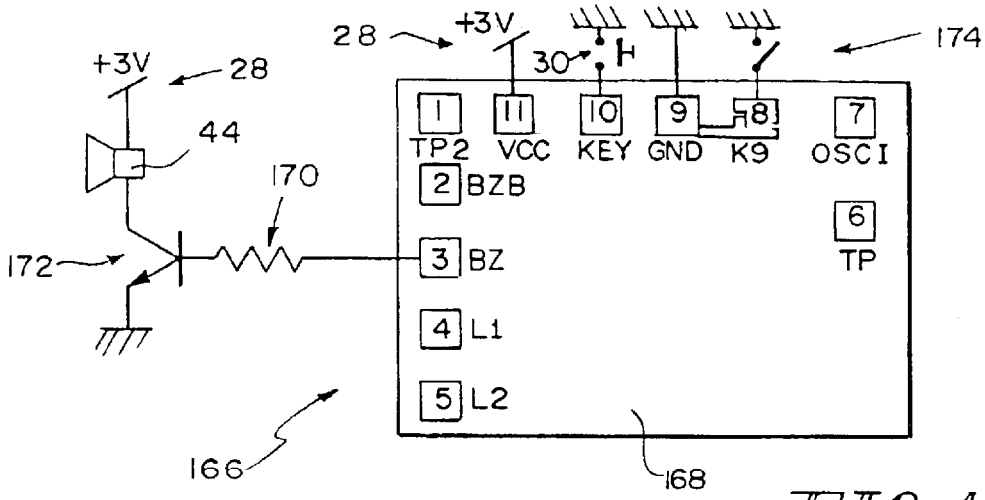
FIG. 10 is a schematic diagram of an electric circuit associated with a lid having a sound-producing device.
Figure 11:
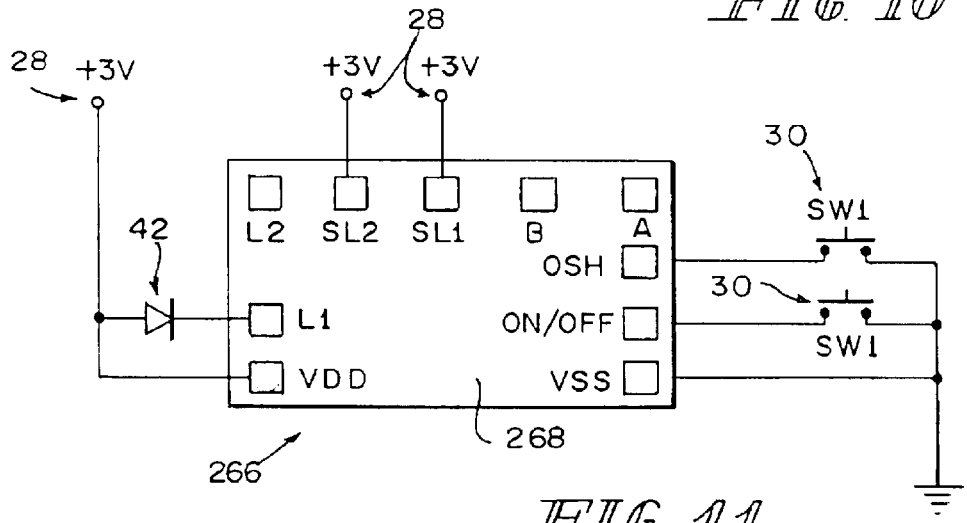
FIG. 11 is a schematic diagram of an electric circuit associated with a lid having a single, pulsing light-emitting diode.

Referring to FIGS. 10 and 11, circuit assembly 22 in accordance with this disclosure may include integrated circuit chips and other circuit components. In the detailed description that follows with regard to FIGS. 10 and 11, certain circuit components, including integrated circuit elements, are identified, and in some instances, certain terminal names or pin numbers for the illustrative circuit elements are identified. This should not be interpreted to mean that the identified circuit components are the only components available that will perform the described functions. Other circuit components are typically available which will perform the described functions. The terminal names and pin numbers of such other circuit components may or may not be the same as those indicated for the specific circuits identified in this disclosure. In addition, any pin numbers or terminal names given are provided for illustrative purposes only, and it should be understood that circuit components may be coupled together through other pins or terminals without exceeding the scope of this disclosure.

One exemplary circuit 166, shown in FIG. 10, optionally may be used in any of lids 10, 110, 210 and includes a model no. MT-8150 integrated circuit chip 168 which is available from Authority Technology Corp. of Taipei, Taiwan. Chip 168 controls the sound produced by the associated sound source 44. Pins 1–11 of chip 168 are identified as TP2, BZB, BZ, L1, L2, TP, OSCI, K9, GND, KEY, and VCC, respectively. Pins 1, 2, 4, 5, 6, and 7 of chip 168 are open. Pin 3 of chip 168 is coupled through a current-limiting resistor 170 to the base of an NPN transistor 172. The emitter of transistor 172 is coupled to ground and the collector of transistor 172 is coupled to a first terminal of a buzzer, speaker, or sound source 44. A second terminal of sound source 44 is coupled to a +3 Volt (V) power supply 28. Pin 8 of chip 168 is coupled to ground through a switch 174 and pin 9 of chip 168 is coupled directly to ground. Pin 10 of chip 168 is coupled to ground through button 30 (or alternatively, switch assembly 36) and pin 11 of chip 168 is coupled to the +3V power supply 28.

Another exemplary circuit 266, shown in FIG. 1, optionally may be used in any of lids 10, 10, 210 and includes a model no. SC188-22 integrated circuit chip 268 which is available from Chen Da Electronics Factory located in Dong Guan, China. Chip 268 controls an LED or light source 42. The A, B, and L2 terminals of chip 268 are open. The L1 terminal of chip 268 is coupled to the cathode of LED 42. The anode of LED 42 is coupled to a +3 V power source 28 and to the VDD terminal of chip 268. The SL1 and SL2 terminals of chip 268 are coupled directly to the +3 V power source 28. The OSH and ON/OFF terminals of chip 268 are coupled to ground and to the VSS terminal of chip 268 through button 30 (or alternatively, switch assembly 36).

Figure 12:
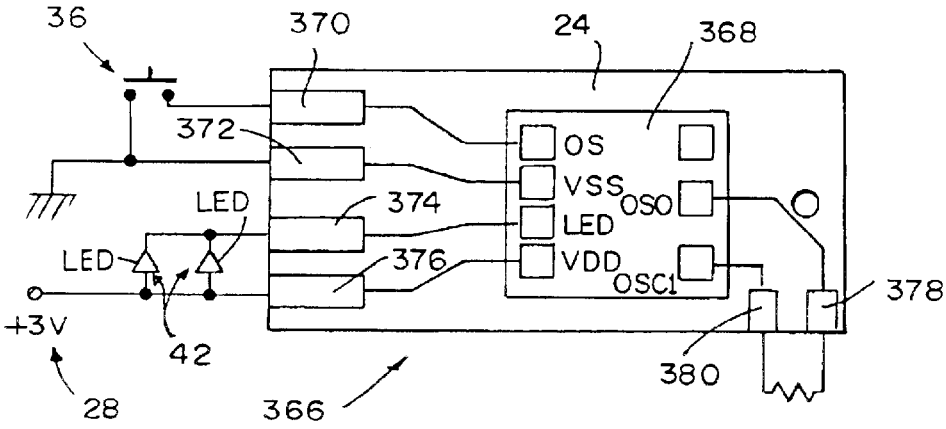
FIG. 12 is a schematic diagram of an electric circuit associated with a lid having a pair of light-emitting diodes.

Referring now to FIG. 12, an exemplary analog circuit 366 includes a circuit board 368 that is coupled to housing 24. Board 368 and housing 24 have various terminal pads to which conductors are coupled, such as via soldering. An OS terminal of board 368 is coupled to a first terminal pad 370 of housing 24. Pad 370 is coupled to ground and to a second terminal pad 372 of housing 24 through switch assembly 36. Pad 372 is coupled to a VSS terminal of board 368. An LED terminal of board 368 is coupled to third terminal pad 374 of housing 24 and a VDD terminal of board 368 is coupled to a fourth terminal pad 376 of housing 24. A parallel pair of LED's 42 have their cathodes coupled to pad 374 and their anodes coupled to pad 376. In addition, the anodes of LED's 42 and pad 376 are coupled to a +3 V power source 28. An OSO terminal of board 368 is coupled to a fifth terminal pad 378 of housing 24 and an OSC1 terminal of board 368 is coupled to a sixth terminal pad 380. Pad 378 is coupled to pad 380 through a current-limiting resistor 382. Various conductive connections (not shown) are made on board 368 so that when switch assembly 36 is closed, LED's 42 are lit. Although the disclosure has been described in detail with reference to certain preferred embodiments, variations, and modifications exist within the scope and spirit of the disclosure as described and as defined in the following claims.

What is claimed is:

1. A lid for coupling to an open top of a container, the lid comprising a top wall that covers at least a portion of the open top of the container when the lid is coupled to the pail, a rim extending downwardly from the top wall, the rim having a bottom edge and being configured to be positioned outside the container when the lid is coupled to the container, a button coupled to the top wall, and an indicator that is activated in response to the button being pressed downwardly toward the container, the indicator being positioned above the bottom edge of the rim.

2. The lid of claim 1, wherein the top wall has a decorative face and the button is associated with a nose of the decorative face.

3. The lid of claim 2, wherein the decorative face comprises an image of a jack-o'-lantern.

4. The lid of claim 2, wherein the decorative face comprises an image of a Frankenstein-like monster.

5. The lid of claim 2, wherein the indicator is associated with an eye of the decorative face.

6. The lid of claim 5, wherein the top wall has an aperture that is generally mouth-shaped and offset from a central region of the lid.

7. The lid of claim 1, wherein the top wall has an image of a heart.

8. The lid of claim 7, wherein the button is generally in the shape of an arrow.

9. The lid of claim 7, wherein the indicator comprises a pulsing light source.

10. The lid of claim 1, wherein the top wall has an image of a Christmas tree.

11. The lid of claim 1, wherein the indicator comprises a light source.

12. The indicator of claim 11, wherein the light source comprises a light-emitting diode.

13. The lid of claim 1, wherein the indicator comprises a sound source.

14. The lid of claim 1, further comprising a power source coupled to a central region of an underside of the top wall.

15. A lid for coupling to an open top of a container, the lid comprising a top wall configured to cover at least a majority of the open top of the container, a user input supported with respect to the top wall, and an indicator that is activated in response to the user input being moved relative to the top wall, the top wall having an aperture that is offset from a center of the top wall and that is aligned vertically with the indicator.

16. The lid of claim 15, further comprising a rim extending downwardly from the top wall, a locator lug extending from the rim, and the lug being adapted for receipt in a guide notch in a chime of the container.

17. A lid for coupling to an open top of a container, the lid comprising a top wall formed with an aperture offset from a central region of the lid, a user input coupled to the top wall, an indicator that is activated in response to the user input being moved relative to the top wall, the indicator being viewable through a second aperture formed in the top wall.

18. The lid of claim 17, wherein the top wall has an image of a face and the second aperture formed in the top wall is associated with an eye of the face.

19. A container assembly comprising a pail having a side wall defining a central axis of the pail, a handle coupled to opposite sides of the sidewall for pivoting movement about a handle pivot axis that is orthogonal to the central axis, a lid coupleable to the pail, the lid having a top wall with an indicator and circuitry for illuminating the indicator coupled to the top wall, and means for preventing the lid from altering its position relative to the pail when the lid is coupled to the pail preventing rotation of the lid about the central axis.

20. The container assembly of claim 19, wherein the preventing means comprises a first stop provided on the lid and a second stop provided on the pail.

* * * * *